US006590351B2

(12) United States Patent
Huber

(10) Patent No.: US 6,590,351 B2
(45) Date of Patent: Jul. 8, 2003

(54) OPERATING DEVICE FOR AT LEAST ONE ELECTRIC LAMP WITH A CONTROL INPUT, AND AN OPERATING METHOD FOR ELECTRIC LAMPS CONNECTED TO SUCH AN OPERATING DEVICE

(75) Inventor: Andreas Huber, Traunreut (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/983,709

(22) Filed: Oct. 25, 2001

(65) Prior Publication Data

US 2002/0050796 A1 May 2, 2002

(30) Foreign Application Priority Data

Oct. 27, 2000 (DE) ..... 100 53 590

(51) Int. Cl.[7] ..... H05B 37/00
(52) U.S. Cl. ..... 315/291; 315/224; 315/276
(58) Field of Search ..... 315/224, 225, 315/219, 291, 307, 308, 209 K, 276

(56) References Cited

U.S. PATENT DOCUMENTS 3,947,762 A * 3/1976 Hug ..... 324/142
4,700,113 A * 10/1987 Stupp et al. ..... 315/224
5,969,482 A * 10/1999 Gradzki ..... 315/224

* cited by examiner

*Primary Examiner*—Don Wong
*Assistant Examiner*—Wilson Lee
(74) *Attorney, Agent, or Firm*—Carlo S. Bessone

(57) ABSTRACT

The invention relates to an operating method and an operating device for at least one electric lamp (11), which device has a control input (13, 14) for prescribing a setpoint for the brightness control of the lamp (11), and a transformer (15) for transmitting the voltage impressed on the control input (13, 14) to an evaluation device (16) which serves to evaluate the voltage impressed on the control input (13, 14). According to the invention, the evaluation device (16) comprises a sample-and-hold element (22) and means (19, 21, 24) are provided for matching the frequency of the sequence signal of the sample-and-hold element (22) to the frequency of a periodically varying voltage which excites the transformer (15) to transmit the voltage impressed on the control input (13, 14) to the evaluation device (16), and means (19, 21, 24) for producing a temporary constant phase shift between the sequence signal of the sample-and-hold element (22) and the periodically varying voltage exciting the transformer to transmit.

6 Claims, 2 Drawing Sheets

Figure 1:
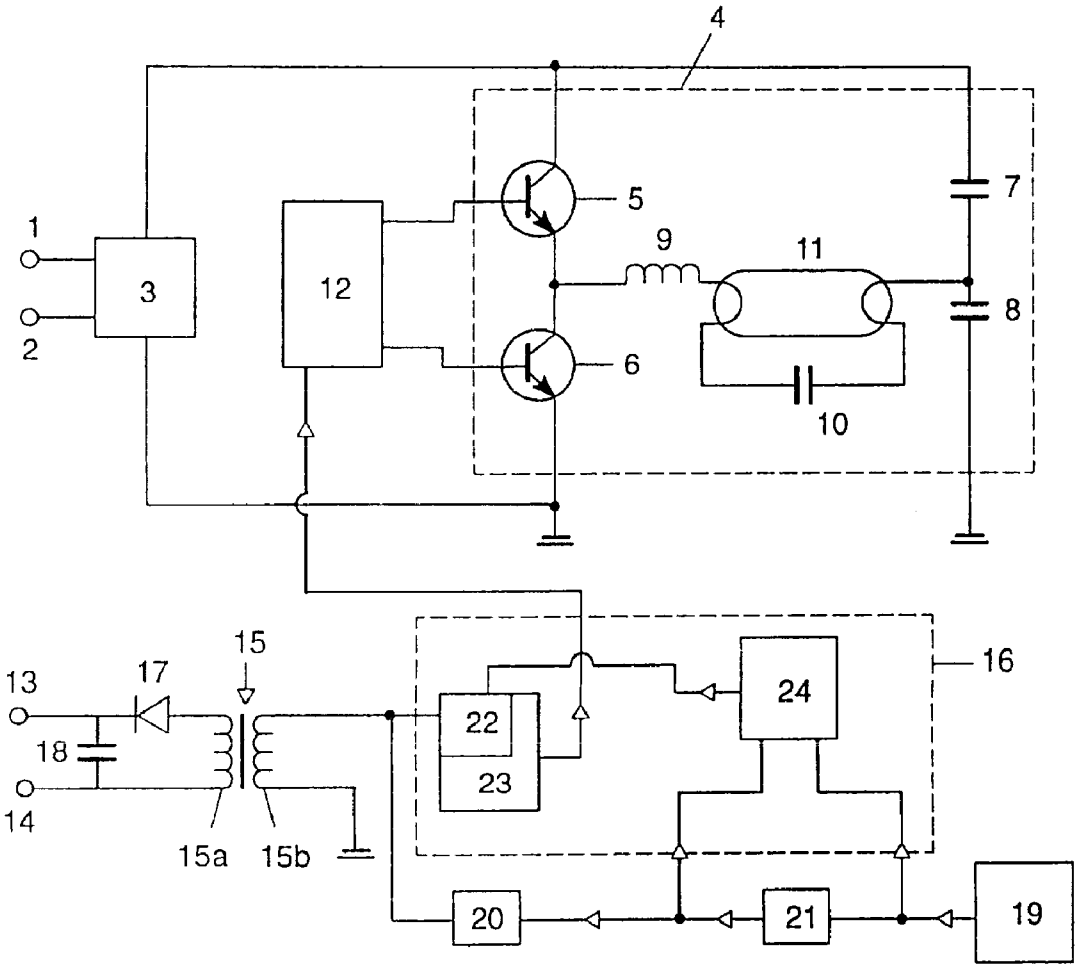

OPERATING DEVICE FOR AT LEAST ONE ELECTRIC LAMP WITH A CONTROL INPUT, AND AN OPERATING METHOD FOR ELECTRIC LAMPS CONNECTED TO SUCH AN OPERATING DEVICE

The invention relates to an operating device for operating at least one electric lamp and to an operating method for at least one electric lamp.

I. TECHNICAL FIELD

There are commercially available operating devices, termed dimmable electronic ballasts (EVGs) for operating electric lamps which permit a dimmed operation, that is to say brightness control of the lamps connected thereto, in particular fluorescent lamps or halogen incandescent lamps. These dimmable operating devices have a control input to which a voltage serving as setpoint for brightness control can be applied. The control input is usually constructed as a 1–10 V interface. In the simplest case, a dimming potentiometer is connected to this control input in order to set the brightness of the lamp, operated using the operating device, to the setpoint. With the aid of the dimming potentiometer and with the aid of a transformer excited by a voltage varying periodically with time, a voltage with a value of between 1 V and 10 V which represents the setpoint for the desired brightness setting is generated at the control input. This voltage is transmitted to an evaluation device in the operating device by means of the transformer. Moreover, the transformer also effects electrical isolation between the control input and the evaluation device in the operating device. With the aid of a peak value rectifier, the evaluation device generates a signal, corresponding to the setting at the dimming potentiometer, for controlling the lamp current or the power consumption of the lamp, or for controlling the output power of the operating device. The properties of the transformer, in particular its leakage inductance, exert a large influence on the voltage transmitted to the evaluation device. A high leakage inductance of the transformer causes disturbing voltage pulses on the transmitted voltage which are interpreted by the evaluation device as controlled variables. Use has therefore been made so far of specifically constructed toroidal core transformers which have a low leakage inductance, and moreover a lowpass filter has been connected upstream of the evaluation device in the operating device in order to reduce voltage peaks.

II. SUMMARY OF THE INVENTION

It is the object of the invention to provide an operating device for operating at least one electric lamp, which has an improved evaluation device for evaluating the voltage present at the control input and transmitted by the transformer. It is also the object of the invention to provide an improved method for operating at least one electric lamp connected to an operating device for electric lamps which has a control input for prescribing an electric voltage serving as setpoint for controlling an operating parameter of the at least one electric lamp.

These objects are achieved according to the invention by means of the features of the independent patent claim 1 and the independent patent claim 7. Particularly advantageous designs of the invention are described in the dependent claims.

The operating device according to the invention for operating at least one electric lamp has a control input to which an electric voltage can be applied which serves as setpoint for controlling an operating parameter of the at least one electric lamp, and has a transformer which is provided for transmitting to an evaluation device the electric voltage which is impressed on the control input and serves as setpoint for controlling an operating parameter of the at least one electric lamp and having an oscillator for exciting the transformer with an electric voltage changing periodically with time. According to the invention, the evaluation device has a sample-and-hold element. Moreover, means are provided for matching the frequencies of the sequence signal of the sample-and-hold element and the electric voltage changing periodically with time, and for producing a temporary constant phase shift between the sequence signal of the sample-and-hold element and the electric voltage changing periodically with time, in order to remove peaks in the voltage transmitted by the transformer. Owing to these measures, it is possible to use cost effective transformers with a comparatively high leakage inductance as transformers in the operating device. Moreover, it is possible to dispense with a lowpass and a peak value rectifier for evaluating the voltage transmitted by the transformer.

The sample-and-hold element is advantageously constructed as a constituent of an analog to digital converter in order to generate a digital control signal for a microcontroller or an integrated circuit which serves to control the operating device. The transformer serving as transformer advantageously has a first winding which is connected to the control input, and has at least one second winding which is connected to the evaluation device and coupled magnetically to at least one first winding. Electrical isolation is thereby ensured between the control input and the evaluation device.

The means for matching the frequencies of the sequence signals of the sample-and-hold element and the electric voltage changing periodically with time, and for producing a constant time shift between the sequence signal of the sample-and-hold element and the electric voltage changing periodically with time advantageously comprised an oscillator for generating the sequence signal, a frequency divider for halving the frequency of the electric voltage changing periodically with time, and a device for matching the frequency of the sequence signal to the electric voltage changing periodically with time, and for producing the constant time shift.

An AND gate is advantageously used as device for the frequency matching of the sequence signal to the electric voltage changing periodically with time, and for producing the constant time shift. Any peaks on the voltage transmitted by the transformer can be removed in this way cost-effectively and with simple means.

The operating method according to the invention is distinguished according to the invention in that the voltage at the transformer is fed to a sample-and-hold element for the purpose of evaluation, in order to remove peaks in the voltage of the transformer with the aid of the sample-and-hold element. Advantageously, in order to evaluate the voltage at the transformer the frequencies of the electric voltage varying periodically with time and of the sequence signal of the sample-and-hold element are matched, and the sequence signal of the sample-and-hold element is delayed by a constant time interval by comparison with the electric voltage varying periodically with time. The sequence signal of the sample-and-hold element is synchronized by this measure with the part of the voltage present at the transformer which has been transmitted without disturbance. A particularly simple and cost effective operating method is disclosed in claim 7. In accordance therewith, the following method steps are carried out in order to evaluate the voltage at the transformer:

using an oscillator to generate the sequence signal and the electric voltage varying periodically with time, using a frequency divider to halve the frequency of the electric voltage varying periodically with time, matching the frequency of the sequence signal to the frequency of the electric voltage varying periodically with time, and generating a constant time shift between the sequence signal and the electric voltage varying periodically with time, applying the electric voltage varying periodically with time to the transformer, and transmitting the voltage at the transformer to the sample-and-hold element as input voltage.

The output voltage of the sample-and-hold element is advantageously used to control the operating parameter of the at least one electric lamp, or converted in advance into a digital signal by means of an analog-to-digital converter.

III. BRIEF DESCRIPTION OF THE DRAWINGS

The invention is explained in more detail below with the aid of a preferred exemplary embodiment. In the drawing:

FIG. 1 shows a schematic of a block diagram of the preferred exemplary embodiment of the operating device according to the invention, and FIGS. 2A–D show schematics of the temporal variation in the exciting voltage, the voltage at the transformer, the sequence signal (sample-and-hold) and the output voltage of the sample-and-hold element.

IV. DESCRIPTION OF THE PREFERRED EXEMPLARY EMBODIMENT

The exemplary embodiment of the invention illustrated in FIG. 1 is a dimmable operating device for a fluorescent lamp. The operating device has two system voltage terminals 1, 2 and a downstream DC voltage supply 3 for a half-bridge inverter 4. The DC voltage supply 3 usually contains a radio interference suppression filter and a rectifier for the system AC voltage. Moreover, it can also have a harmonic filter in order to ensure that line current is drawn as sinusoidally as possible. The half-bridge inverter 4 comprises two alternately switching transistors 5, 6, two coupling capacitors 7, 8, and a half-bridge arm which is constructed as a series resonant circuit and contains the inductor 9, the capacitor 10 and the fluorescent lamp 11, the discharge path of the fluorescent lamp 11 being connected in parallel with the capacitor 10. The half-bridge inverter need not necessarily be constructed as a symmetrical half-bridge inverter 4 with two coupling capacitors 5, 6, but can, instead, also have only one coupling capacitor and therefore be constructed as an asymmetrical half-bridge converter. The transistors 5, 6 of the half-bridge inverter 4, which are preferably field effect transistors, are controlled by a microcontroller 12. The microcontroller 12 generates pulse-width-modulated signals which determine the switching cycle of the transistors 5, 6, and thereby permit the power or the brightness of the fluorescent lamp 11 to be controlled. The pulse-width-modulated signals for the transistors 5, 6 are generated by the microcontroller 12 as a function of the DC voltage present at the terminals 13, 14 of the control input. A DC voltage with values of between 1 V and 10 V can be impressed on the control input 13, 14. A setpoint for the desired power or brightness of the fluorescent lamp 11 is determined by the value of the DC voltage impressed on the control input 13, 14. In the simplest case, a dimming potentiometer (not illustrated) which is connected to the terminals 13, 14 serves to generate and prescribe a value of this DC voltage.

The voltage impressed on the control input 13, 14 is transmitted to an evaluation device 16 by means of a transformer 15. For this purpose, the primary winding 15*a* of the transformer 15 is connected via a rectifier diode 17 to the control input 13, 14, while the secondary winding 15*b* is connected to the voltage input of the evaluation circuit 16. There is a magnetic coupling between the primary winding 15*a* and the secondary winding 15*b* of the transformer 15. An input capacitor 18 is connected in parallel with the control input 13, 14 and with the primary winding 15*a*. In order for the transformer 15 to be able to transmit the DC voltage impressed on the control input 13, 14 to the evaluation device 16, the transformer 15 is excited with a substantially square-wave voltage. This substantially square-wave voltage is generated by means of an oscillator 19 and a frequency divider 21, and applied to the secondary winding 15*b* via a voltage divider resistor 20. The evaluation device 16 therefore detects at its voltage input connected to the secondary winding 15*b* a substantially square-wave voltage whose amplitude is determined by the DC voltage impressed on the control input 13, 14. The evaluation device 16 provides at its voltage output connected to the microcontroller 12 a corresponding signal for the microcontroller 12 for the purpose of controlling the power or brightness of the fluorescent lamp 11.

The evaluation device 16 has a sample-and-hold element 22 which is constructed as a constituent of an analog-to-digital converter 23, and an AND gate 24. The sample-and-hold element 22 and the AND gate 24 are used to remove the voltage peaks, caused by the leakage inductance of the transformer 15, on the leading edge of the square-wave voltage of the secondary winding 15*b*. This state of affairs is explained in more detail below with the aid of FIGS. 2A–D.

Figure 2:
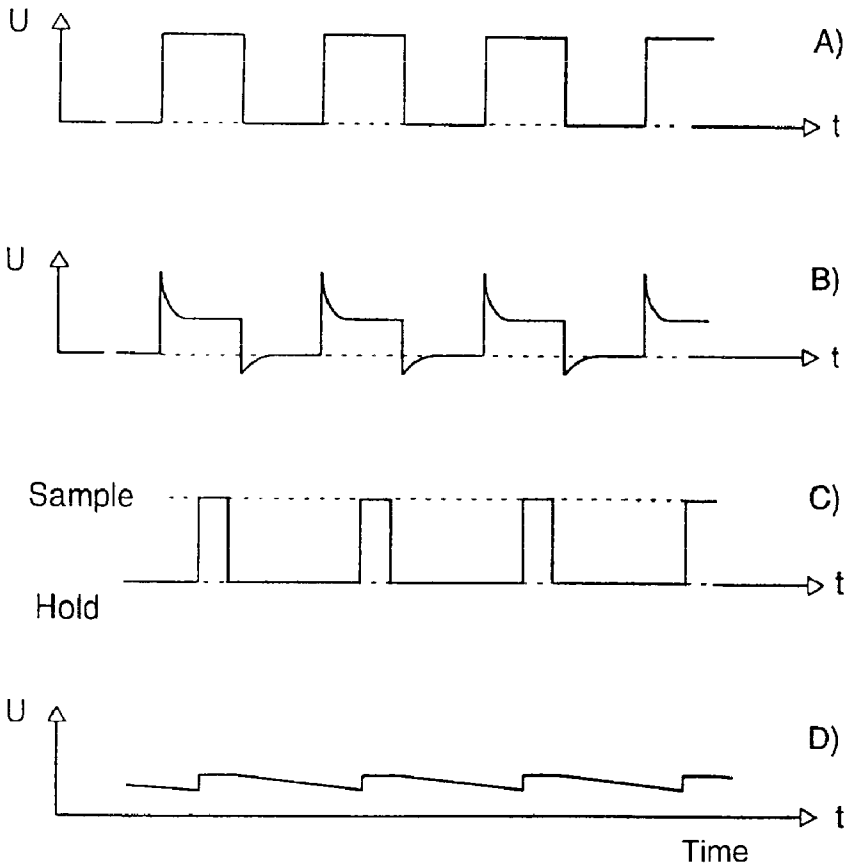

FIG. 2A shows the temporal variation in the square-wave voltage U, which is used to excite the transformer 15. This square-wave voltage is generated by means of the oscillator 19 and the frequency divider 21, which halves the frequency, and applied to the secondary winding 15*b* via the resistor 20. As already mentioned above, this exciting voltage changing periodically with time is required in order to permit transmission of the DC voltage, impressed on the control input 13, 14, by the transformer 15.

FIG. 2B shows the temporal variation in the voltage U present at the secondary winding 15*b* and detected by the voltage input of the evaluation circuit 16. This voltage present at the secondary winding 15*b* has the periodicity of the exciting voltage (FIG. 2A). Its amplitude—that is to say the height of the square-wave pulse—is, however, determined by the value of the DC voltage impressed on the control input 13, 14. However, because of the leakage inductance of the transformer 15 disturbing voltage pulses are superimposed on the leading and the trailing edges of the square-wave voltage at the secondary winding 15*b* (FIG. 2B). The disturbing voltage pulses are removed with the aid of the sample-and-hold element 22. For this purpose, the duration and the start of the sequence signal (also termed sample signal) of the sample and hold element 22 are adapted to the voltage at the secondary winding 15*b*.

FIG. 2C shows the temporal variation in the sequence signal of the sample-and-hold element 22. The duration of the sequence signal (FIG. 2C) is exactly half as long as a square-wave pulse of the voltage (FIG. 2B) at the secondary winding 15*b*, and the sequence signal is synchronous with the second half of the square-wave pulses of the voltage at the secondary winding 15*b*. The disturbing voltage pulses on the leading and trailing edges of the square-wave voltage are thereby removed. This tuning of the sequence signal to the voltage at the secondary winding 15*b* is carried out with the aid of the frequency divider 21, constructed as a J–K flip flop, of the AND gate 24 and of the oscillator 19. The oscillator 19 generates both the voltage (curve A) exciting the transformer 15, and the sequence signal (FIG. 2C). The square-wave voltage generated by the oscillator 19 is fed, on the one hand, to the first voltage input of the AND gate 24 and, on the other hand, to the voltage input of the frequency divider 21, which halves the frequency of the square-wave voltage fed to it. The square-wave voltage present at the voltage output of the frequency divider 21 and whose frequency has been halved, is, on the one hand, fed to the second voltage input of the AND gate 24 and, on the other hand, applied to the secondary winding 15*b* via the voltage divider resistor 20 in order to excite the transformer 15. The output voltage of the AND gate 24 is fed to the sample-and-hold element 22 as sequence signal (FIG. 2C), or is used to control the sequence-and-hold signal (also termed sample-and-hold signal) of the sample-and-hold element 22. The sequence signal of the sample-and-hold element 22 (FIG. 2C) is therefore synchronous with the second half of the square-wave pulse of the exciting voltage (FIG. 2A) and therefore also synchronous with the second half of the voltage pulse of the voltage (FIG. 2B) present at the secondary winding 15*b*.

FIG. 2D shows the temporal variation in the output voltage U of the sample-and-hold element 22, which is converted by the analog-to-digital converter 23 into a digital signal for the microcontroller 12 for the purpose of pulse-width-modulated control of the transistors 5, 6. In the ideal case, the output voltage of the sample-and-hold element 22 is a DC voltage whose value is a function only of the DC voltage impressed on the control input 13, 14. The output voltage of the sample-and-hold element 22 (FIG. 2D) exhibits a ribbed structure because of the losses in the sample-and-hold element 22.

The oscillator 19 is identical in the preferred exemplary embodiment to the half-bridge inverter 4. The square-wave voltage (FIG. 2A) exciting the transformer 15, and the sequence signal (FIG. 2C) of the sample-and-hold element 22 are generated by capacitive decoupling at the center tap between the half-bridge inverter transistors 5, 6, or or at the center tap between the coupling capacitors 7, 8.

The sample-and-hold element 22, the analog-to-digital converter 23 and the AND gate 24 are preferably constructed as a constituent of the microcontroller 12.

The invention is not limited to the exemplary embodiment described in more detail above. For example, the control input (13, 14) need not necessarily be constructed as an analog control input to which a DC voltage can be applied. Instead of this, the control input can also be constructed as a digital control input to which it is possible to apply digital signals for the purpose of prescribing a setpoint for controlling the brightness of the at least one lamp.

I claim:

1. An operating device for operating at least one electric lamp, the operating device comprising:

a control input (13, 14) for receiving a first electric voltage serving as a setpoint for control of an operating parameter of the at least one electric lamp (11), a transformer (15) having an input connected to the control input for receiving the first electric voltage and an output connected to an evaluation device (16), and an oscillator (19) connected to the output of the transformer (15) for producing a second electric voltage which changes periodically with time, the evaluation device (16) having a sample-and-hold element (22), and means (19, 21, 24) for matching frequencies of a sequence signal of the sample-and-hold element (22) and the second electric voltage, and for producing a phase shift between the sequence signal of the sample-and-hold element (22) and the second electric voltage in order to remove peaks in a combined voltage transmitted by the transformer (15) to the evaluation device (16).

2. The operating device as claimed in claim 1, wherein the means (19, 21, 24) for matching the frequencies of the sequence signal of the sample-and-hold element (22) and the second electric voltage, and for producing a phase shift between the sequence signal of the sample-and-hold element (22) and the second electric voltage comprises an oscillator (19) for generating the sequence signal, a frequency divider (21) for halving the frequency of the second electric voltage, and a device (24) for matching the frequency of the sequence signal to the second electric voltage.

3. The operating device as claimed in claim 1, wherein the transformer (15) has at least one first winding (15*a*) connected to the control input (13, 14), and has at least one second winding (15*b*) connected to the evaluation device (16) and coupled magnetically to the at least one first winding (15*a*).

4. The operating device as claimed in claim 1, wherein the evaluation device (16) has an analog-to-digital converter (23) and the sample-and-hold element (22) is constructed as a constituent of the analog-to-digital converter (23).

5. The operating device as claimed in claim 1, wherein the control input (13, 14) is constructed as an analog control input to which a DC voltage can be applied.

6. The operating device as claimed in claim 1, wherein the control input is constructed as a digital control input to which digital signals can be applied.

* * * * *